US006890210B2

(12) United States Patent
Lee

(10) Patent No.: US 6,890,210 B2
(45) Date of Patent: May 10, 2005

(54) CABLE CONNECTOR ASSEMBLY WITH IDC CONTACTS

(75) Inventor: George Lee, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 23 days.

(21) Appl. No.: 10/394,800

(22) Filed: Mar. 21, 2003

(65) Prior Publication Data

US 2004/0185703 A1 Sep. 23, 2004

(51) Int. Cl.[7] ..... H01R 4/24
(52) U.S. Cl. ..... 439/404; 439/417; 439/397
(58) Field of Search ..... 439/404, 405, 439/417, 397, 492, 459

(56) References Cited

U.S. PATENT DOCUMENTS 3,936,128 A 2/1976 Annessa et al.
4,410,222 A 10/1983 Enomoto et al.
5,030,132 A 7/1991 Hayes et al.
5,338,221 A 8/1994 Bowen et al.
5,915,990 A * 6/1999 Beer et al. ..... 439/417
6,210,204 B1 * 4/2001 Ko et al. ..... 439/404
6,220,890 B1 * 4/2001 Turek et al. ..... 439/459
6,416,349 B1 7/2002 Lee
6,524,127 B2 2/2003 Turek et al.

FOREIGN PATENT DOCUMENTS

TW 517895 1/2003

* cited by examiner

*Primary Examiner*—Gary Paumen
(74) *Attorney, Agent, or Firm*—Wei Te Chung

(57) ABSTRACT

A cable connector assembly (1) includes an insulative housing (2), a number of contacts (3), a number of wires (4), and a cover (5) mounted to the housing. The insulative housing has a number of passageways (24) in a front portion (20) and a number of posts (27) on a rear portion (22). Every two neighboring posts define a contact-receiving tunnel (26) therebetween. Each contact includes a three-beam mating portion (30) received in the passageways, and an insulation displacement portion (32) received in a corresponding contact-receiving tunnel. The insulation displacement portion includes a first wall (320), a second wall (322), and an intermediate section (324) connecting the first and the second walls. The first and the second walls each define a slot (328), and the slots align with each other. Each wire is received in the slots of a corresponding contact and electrically connected with the contact in the contact-receiving tunnel.

15 Claims, 6 Drawing Sheets

3

CABLE CONNECTOR ASSEMBLY WITH IDC CONTACTS

CROSS-REFERENCES TO RELATED APPLICATION

The subject matter of this patent application is pertinent to a co-pending U.S. patent application Ser. No. 10/293,537, filed on Nov. 12, 2002, entitled "CABLE CONNECTOR ASSEMBLY WITH RELIABLY TERMINATED WIRES" and contemporaneously filed application entitled "CABLE CONNECTOR ASSEMBLY WITH LATCHING MEANS", all invented by the same inventor and assigned to the same assignee as this patent application.

BACKGROUND OF THE INVENTION

1. Field of the Invention

The present invention generally relates to a cable connector assembly, and more particularly to an Insulation Displacement Connection (IDC) cable connector assembly.

2. Description of Related Art

It is common to find the use of IDC technology in the electrical connector industry, because it allows rapid and simple connection of conducting wires to contacts without stripping nor crimping the wires. A typical IDC is made by applying a wire perpendicularly to a planar wall portion of a contact comprising a slot, such that edges of the slot cut through an insulating coating of the wire and make electrical contact with a conductor of the wire. The slots are formed by opposed edges of a sheet metal which is necessarily of a certain width to have sufficient strength to support the contact pressure against the edges.

TW patent issue No. 517895 discloses a cable connector assembly which uses IDC technology interconnecting wires and contacts contained therein for power transmission. The cable connector assembly comprises an insulative housing, a plurality of contacts, a plurality of wires, and a cover secured to the insulative housing. Each contact comprises a three-beam mating portion received in a front portion of the housing for electrically engaging with a complementary connector, and a flat insulation displacement portion defining a slot therein. Each wire comprises a conductor and an outer insulating coating. When the wire is urged into the slot of a corresponding contact, the outer insulating coating is cut by inner edges of the slot of the insulation displacement portion, thereby establishing an electrical connection between the contacts and the conductors.

Each wire of the cable connector assembly used for transmitting power is relatively larger in the dimension thereof than wires for other usages. Therefore, once there is one wire not electrically connected with a corresponding contact reliably, the power transmission therebetween is adversely affected.

U.S. Pat. Nos. 4,410,222, 5,030,132 and 6,524,127 each disclose an IDC contact. These IDC contacts each have two slots therein to increase contact areas between each wire and an insulation displacement portion of a corresponding contact, and to ensure the signal or power transmission between the contact and the wire.

Nevertheless, the insulation displacement portions of the IDC contacts disclosed in U.S. Pat. No. 4,410,222 are fully exposed out of an insulative housing. That is, the insulation displacement portions have no support when a flat cable is urged thereto. This may cause a deformation of the insulation displacement portions and an unreliable signal transmission between the cable and the contacts.

The insulation displacement portions of the contacts disclosed in U.S. Pat. Nos. 5,030,132 and 6,524,127 are supported by inner walls of receiving cavities defined through respective insulative housings. However, the inner walls may partly block an operator's line of sight on inserting of the wires into the dual slots. Therefore, the accuracy of the insertion of the wires is not assured.

Moreover, there is a need to have an additional structure to secure the wires to the contacts for preventing the wires inadvertently separating from the contacts after being received in the slots of the contacts. The contacts disclosed in U.S. Pat. No. 5,030,132 each comprise a pair of claws for preventing the wires from separating from the contacts. However, this complexes the structure of the contact and increases the manufacturing cost thereof.

Hence, a cable connector assembly with improved structure for achieving a reliable transmission is needed to address the problems encountered in the related art.

SUMMARY OF THE INVENTION

An object of the present invention is to provide a cable connector assembly for achieving a more reliable signal or power transmission.

Another object of the present invention is to provide a cable connector assembly for securely attaching wires thereof to contacts thereof.

In order to achieve the objects set forth, a cable connector assembly in accordance with the present invention comprises an insulative housing, a plurality of contacts retained in the housing, a plurality of wires, and a cover. The insulative housing comprises an engaging portion and a terminating portion opposite to the engaging portion. The engaging portion defines a plurality of passageways therein. A plurality of posts are formed on the terminating portion. Every two neighboring posts define a contact-receiving tunnel therebetween. Each contact comprises a mating portion received in a corresponding passageway of the housing, and an insulation displacement portion opposite to the mating portion and received in a corresponding contact-receiving tunnel. The insulation displacement portion comprises a first wall, a second wall opposite to the first wall, and an intermediate section connecting the first and the second walls. The first and the second walls each define a slot therein, and the slots of each contact align with each other. Each wire is received in the slots of a corresponding contact and electrically connected with the contact in the contact-receiving tunnel. The cover is secured to the terminating portion of the insulative housing.

Other objects, advantages and novel features of the invention will become more apparent from the following detailed description when taken in conjunction with the accompanying drawings.

DETAILED DESCRIPTION OF THE INVENTION

Figure 1:
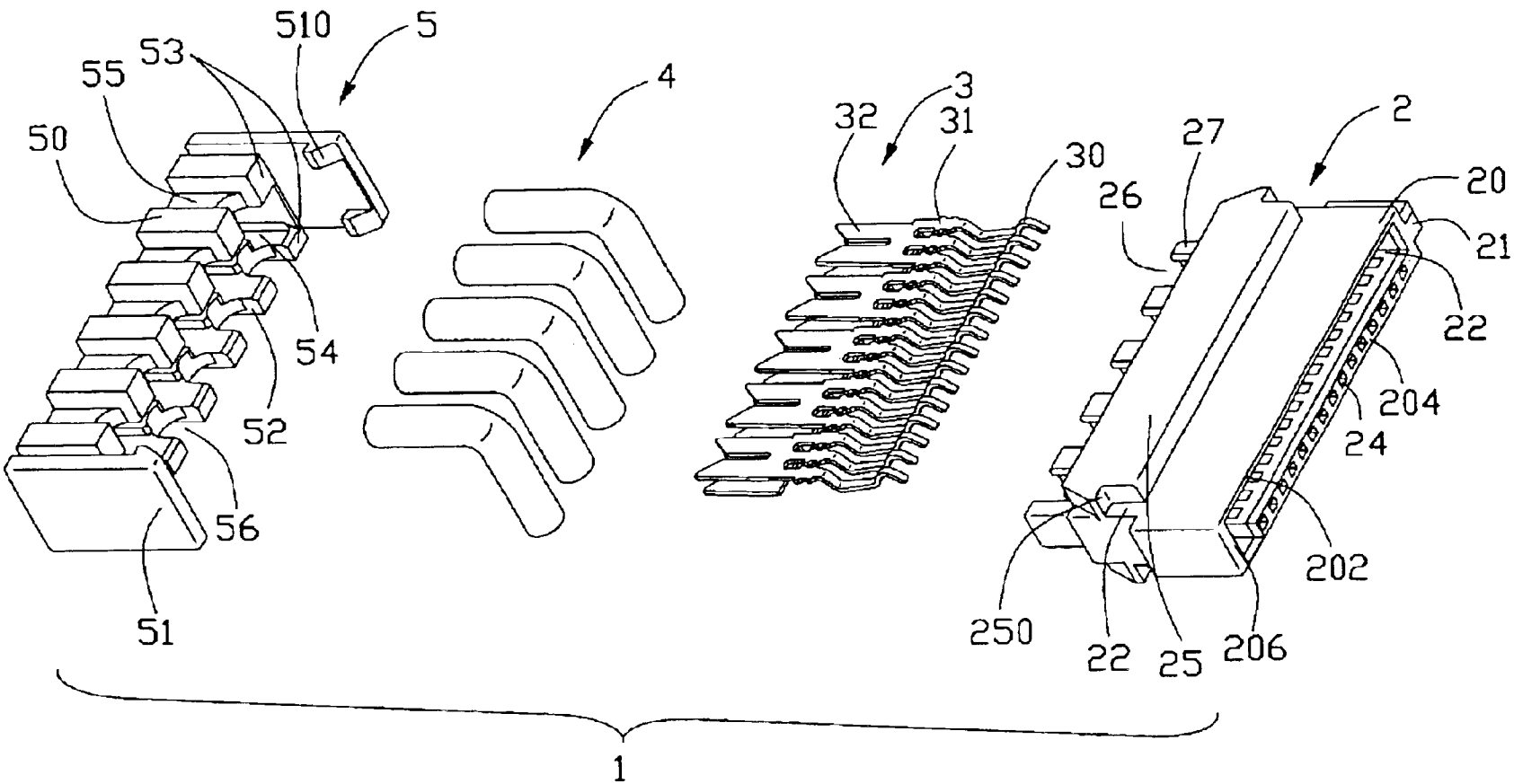
FIG. 1 is an exploded, perspective view of a cable connector assembly in accordance with the present invention.
Figure 2:
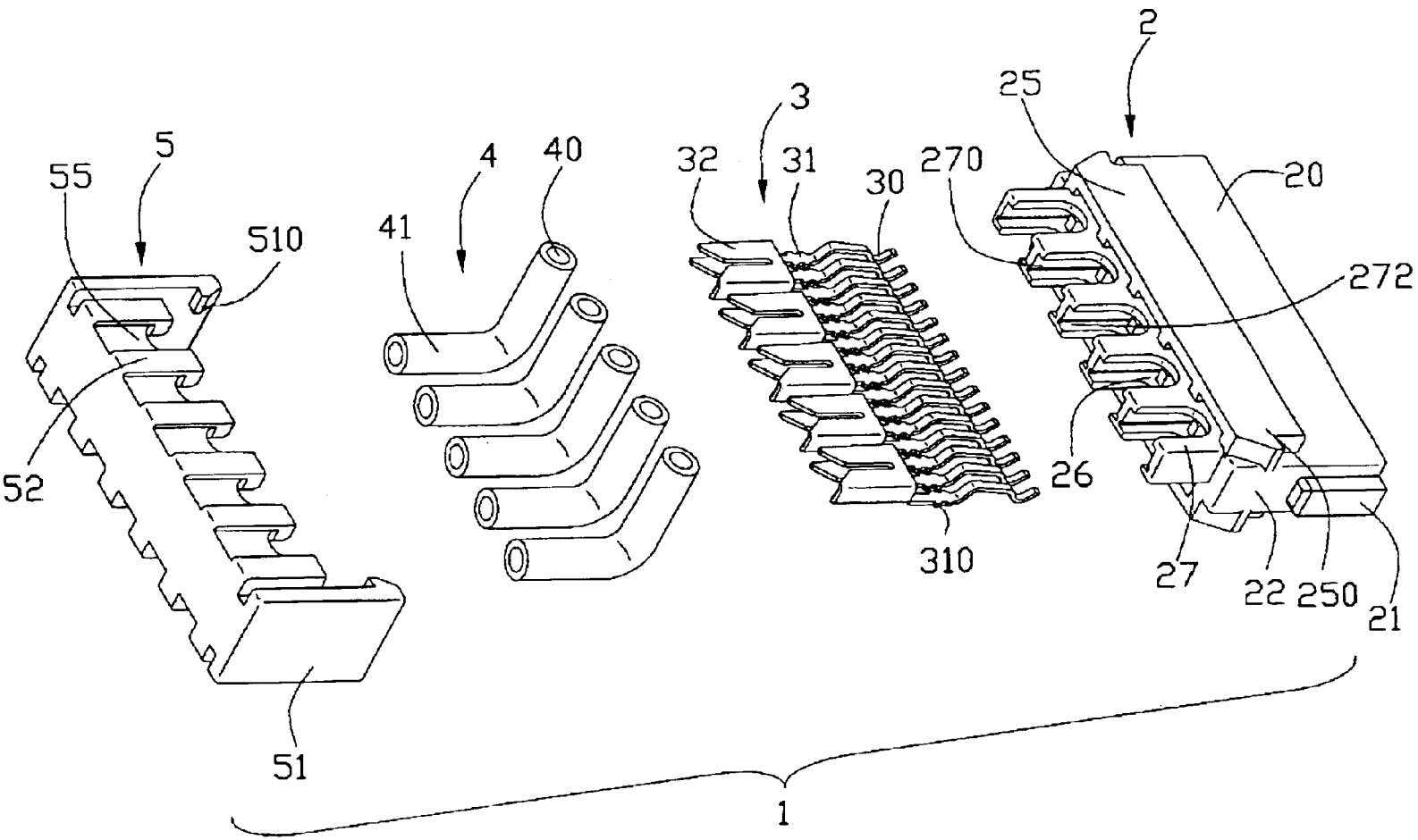
FIG. 2 is a view similar to FIG. 1, but taken from rear and bottom aspects.

Referring to FIG. 1 and FIG. 2, a cable connector assembly 1 in accordance with the present invention comprises an insulative housing 2, a plurality of contacts 3, a plurality of wires 4, and an insulative cover 5.

The insulative housing 2 comprises a front engaging portion 20 and an opposite terminating portion 22. The insulative housing 2 defines an L-shaped receiving space 22 in the engaging portion 20 circled by an upper wall 202, a lower wall 204, and a pair of lateral walls 206. The lower wall 204 is thicker than the upper wall 202 and defines a plurality of passageways 24 therethrough for receiving the contacts 3. A guiding projection 21 projects sidewardly from one sidewall 206 for facilitating an engagement of the cable connector assembly 1 with a complementary connector. The rear terminating portion 22 comprises a pair of protrusions 25 respectively formed on an upper surface and a lower surface of the insulative housing 2, and each protrusion 25 has a pair of hook portions 250 on opposite ends thereof. A plurality of posts 27 protrude respectively beyond the terminating portion 22 and every two neighboring posts 27 together define a U-shaped contact-receiving tunnel 26 therebetween. Each post 27 defines a pair of channels 270 respectively communicating with neighboring contact-receiving tunnels 26. A pair of opposite walls 272 (referring to FIG. 4) and a side surface 274 (referring to FIG. 4) circumscribe the channel 270.

Figure 3:
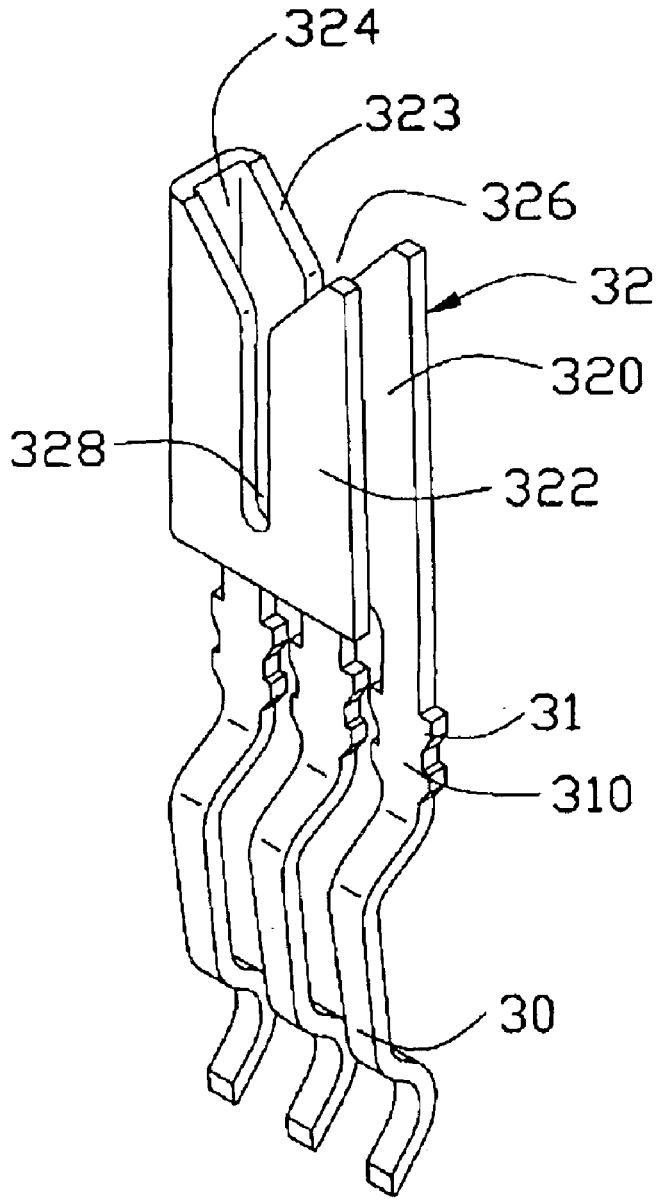
FIG. 3 is a perspective view of a contact of the cable connector assembly.

In conjunction with FIG. 3, each contact 3 has a fork-shaped configuration and comprises a three-beam mating portion 30, a three-beam retention portion 31 extending rearwardly from the mating portion 30, and an insulation displacement portion 32 extending rearwardly from the retention portion 31 for electrically connecting with the wires 4. Each retention portion 31 has a plurality of barbs 310 on opposite sides thereof for retaining the contacts 3 to the insulative housing 2 reliably. The insulation displacement portion 32 comprises a first and a second walls 320, 322 and an intermediate section 324 connecting the walls 320, 322. The first wall 320 extends rearwardly from the three-beam retention portion 31. Each wall 320, 322 defines an elongated slot 328 therein. The walls 320, 322 are oppositely configured such that the slots 328 are aligned with each other, thereby the wire 5 can be inserted into the slots 328 in both walls 320, 322 and remains substantially straight. Each wall 320, 322 has a pair of opposite inwardly inclined edges 323 at a rear section thereof, thereby forming an entry 326 communicating with the slot 328.

Each wire 4 comprises a conductor 40 and an outer insulating coating 41.

The cover 5 comprises a top wall 50, a bottom wall 52 opposite to the top wall 50, and a pair of sidewalls 51 extending partially forwardly beyond front surfaces 53 of the top and bottom walls 50, 52. Each sidewall 51 has a pair of latches 510 in a front end thereof. The top and the bottom walls 50, 52 are partly cutoff to form a plurality of ribs 55. A plurality of hemicyclic wire-receiving holes 56 is defined rearwardly from respective ribs 55. The top and bottom walls 50, 52 and the sidewalls 51 together define a plurality of receiving cavities 54 respectively corresponding to the posts 27 of the housing 2.

Figure 4:
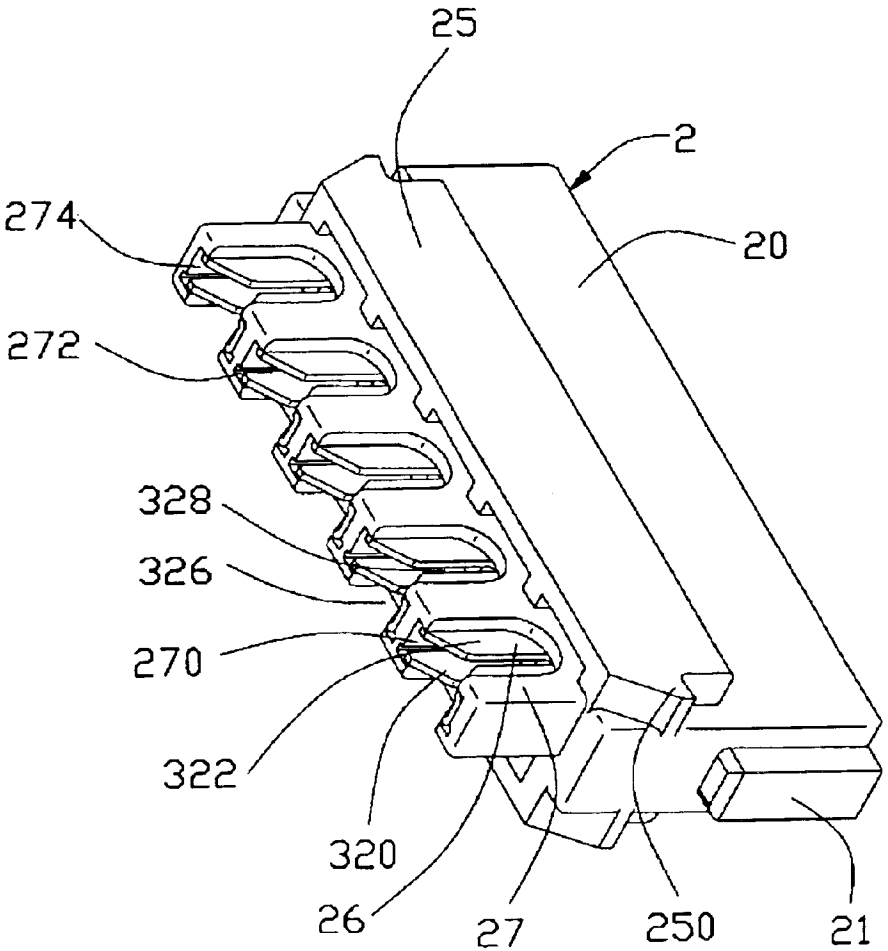
FIG. 4 is an assembled view of the contacts and an insulative housing of the cable connector assembly taken from rear and bottom aspects.

In assembly, referring to FIG. 4, the contacts 3 are inserted into the dielectric housing 2 in a rear-to-front direction. The mating portions 30 of the contacts 3 are respectively received in front portions of the passageways 24 and are partly exposed in the receiving space 22 for electrically connecting with the complementary connector. The retention portions 31 of the contacts 3 are respectively received in rear portions of the passageways 24 and the barbs 310 of each retention portion 31 engage with opposite side surfaces of a corresponding passageway 24. The first and the second walls 320, 322 of each contact 3 are partly received in the pair of channels 270 and extend into a corresponding contact-receiving tunnel 26. The intermediate section 324 abuts against the side surface 274 of the channel 270. Thus, the insulation displacement portions 32 are reliably positioned in the housing 2.

Figure 5:
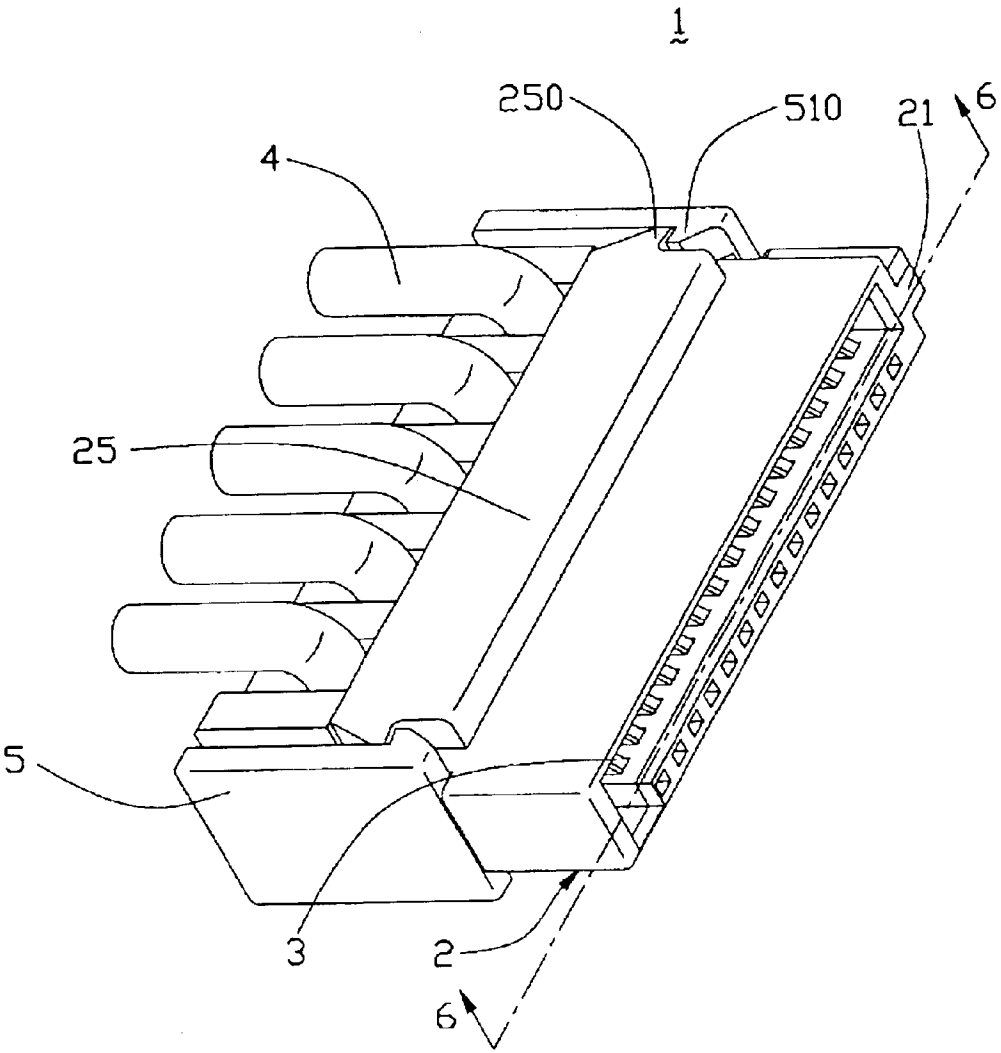
FIG. 5 is an assembled view of the cable connector assembly of FIG. 1.
Figure 6:
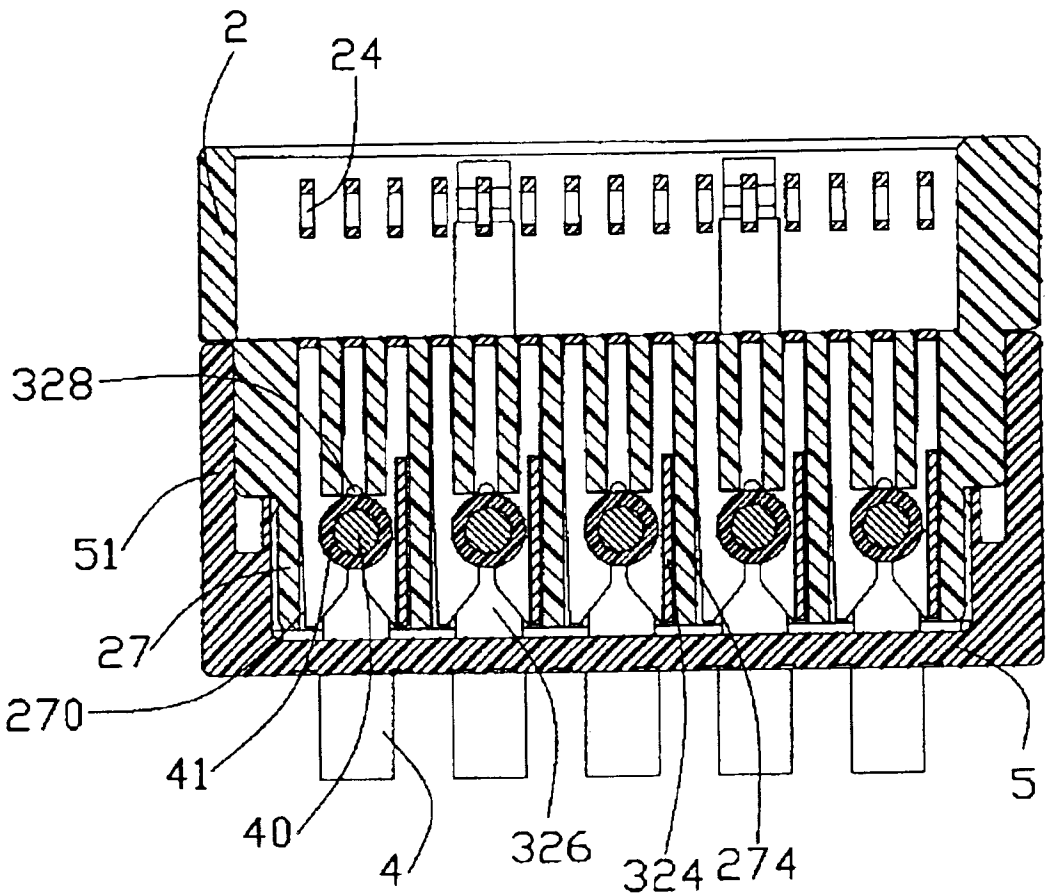
FIG. 6 is a cross-sectional view taken along line 6—6 of FIG. 5.

Referring to FIG. 5 and in conjunction with FIG. 6, the wires 4 are respectively urged into the insulation displacement portions 32. As the wire 4 is positioned in the entry 326, the inwardly inclined edges 323 align the wire 4 with the dual slots 328. Then the wire 4 is urged into the slots 328 with the outer insulating coating 41 cut by inner edges of the slots 328, thereby the insulation displacement portion 32 connects with the conductor 40 and an electrical connection between the contact 3 and the wire 4 is established.

Referring to FIG. 5 and FIG. 6, the insulative cover 5 is assembled to the insulative housing 2. The latches 510 of the cover 5 hook with the hooks 250 of the housing 2. The wires 4 are respectively received in the wire-receiving holes 56 and compressed by the ribs 55 to securely connect with the insulation displacement portions 32. The posts 27 of the housing 2 are respectively received in the receiving cavities 54 of the cover 5. Thus, the wires 4 are secured between the insulation displacement portions 32 and the cover 5.

The dual-slot structure of the insulation displacement portion 32 of the contact 3 increases the contact areas between the contacts 3 and the wires 4, so the electrical connection therebetween is more reliable. Additionally, the insulation displacement portions 32 are supported by the posts 27, so when the wires 4 are urged into the slots 328, the possibility of deformation of the insulation displacement portions 32 is decreased. The ribs 55 of the cover 5 compress the wires 4 to the insulation displacement portions 32 of the contacts 3, thereby preventing the wires 4 from separating from the contacts 3 and assuring a reliable power transmission therebetween.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

an insulative housing comprising an engaging portion and an opposite terminating portion, the engaging portion defining a plurality of passageways therein, the terminating portion comprising a plurality of posts, every two neighboring posts defining a contact-receiving tunnel therebetween;

a plurality of contacts retained in the insulative housing, each contact comprising a mating portion received in a corresponding passageway of the insulative housing, and an insulation displacement portion opposite to the mating portion and received in a corresponding contact-receiving tunnel, the insulation displacement portion comprising a first wall, a second wall opposite to the first wall, and an intermediate section connecting the first and the second walls, the first and the second walls each defining a slot therein, the slots of each contact aligning with each other;

a plurality of wires received in the slots of the contacts and electrically connected with the contacts in the contact-receiving tunnels, respectively; and a cover mounted to the terminating portion of the insulative housing;

wherein the cover comprising a top wall, a bottom wall and a pair of sidewalls extending partially forward beyond the top and bottom walls;

wherein the top and the bottom walls of the cover each are partly cutoff to form a plurality of ribs and a plurality of hemicyclic wire-receiving holes respectively extending rearwardly from the ribs and receiving the wires therein, and wherein the wires are compresses toward the contacts by the ribs.

2. The cable connector assembly as claimed in claim 1, wherein the posts each define a pair of channels communicating with respective contacting-receiving tunnels, and wherein the first and the second walls of the contact are partly received in the channel.

3. The cable connector assembly as claimed in claim 2, wherein each channel of the post is formed by a pair of opposite walls and a side surface, and wherein the intermediate section of the contact abuts against the side surface of the post.

4. The cable connector assembly as claimed in claim 1, wherein each of the first and the second walls of the insulation displacement portion comprises a pair of opposite inwardly inclined edges which together define an entry communicating with the slot.

5. The cable connector assembly as claimed in claim 1, wherein the mating portion is a three-beam mating portion.

6. The cable connector assembly as claimed in claim 5, wherein the contact comprises a three-beam retention portion extending rearwardly from a corresponding mating portion, and wherein the first wall of the insulation displacement portion extends rearwardly from the three-beam retention portion.

7. The cable connector assembly as claimed in claim 6, wherein the engaging portion of the housing defines an L-shaped receiving space therein, and wherein the mating portions of the contacts are partly exposed in the L-shaped receiving space.

8. The cable connector assembly as claimed in claim 7, wherein the housing comprises a guiding post projecting sidewardly therefrom.

9. The cable connector assembly as claimed in claim 1, wherein the terminating portion of the insulative housing comprises a pair of protrusions each formed with a pair of hooks, and wherein the cover comprises two pairs of latches hooking with the hooks of the housing, respectively.

10. The cable connector assembly as claimed in claim 6, wherein the top and bottom walls of the cover together define a plurality of receiving cavities aligning with the posts of the insulative housing and receiving the posts therein.

11. A cable connector assembly, comprising:

an insulative housing comprising an engaging portion and a terminating portion opposite to the engaging portion, the insulative housing comprising a plurality of posts formed on the terminating portion thereof, every two neighboring posts defining a contact-receiving tunnel therebetween;

a plurality of contacts retained in the insulative housing, each contact comprising a mating portion received in the engaging portion of the insulative housing and an insulation displacement portion received in a corresponding contact-receiving tunnel, the insulation displacement portion defining a slot therein;

a plurality of wires received in the slots of the contacts and electrically connected with the contacts in the contact-receiving tunnels, respectively; and a cover comprising a plurality of ribs respectively aligning with the wires and compressing the wires toward the contacts;

wherein the cover comprises a top wall, a bottom wall opposite to the top wall, and a pair of sidewalls, and wherein the walls to ether define a plurality of receiving cavities receiving the posts of the insulative housing therein.

12. The cable connector assembly as claimed in claim 11, wherein the insulation displacement portion of the contact comprises a first wall, a second wall opposite to the first wall, and an intermediate section connecting the first and the second walls.

13. The cable connector assembly as claimed in claim 12, wherein the first and the second walls each define a slot therein, and wherein the slots align with each other.

14. The cable connector assembly as claimed in claim 11, wherein each contact comprises a three-beam mating portion, a three-beam retention portion extending rearwardly from the mating portion, and the insulation displacement portion, and wherein the first wall of the insulation displacement portion extends rearwardly from the retention portion.

15. A cable connector assembly comprising:

an insulative housing including an terminal portion defining a plurality of contact-receiving tunnels therein;

a plurality of contacts disposed in the housing, each of said contacts including an insulation displacement portion supportably received in the corresponding contact-receiving tunnel, wherein a distal end of the insulation displacement portion essentially is hidden behind an outermost edge of the corresponding tunnel;

a plurality of wires applied to the terminal portion and extending perpendicular to said contact-receiving tunnels, the insulation displacement portion piercing into the corresponding wire in a supportable manner instead of a suspended manner; and a cover mounting to said housing and cooperating with the housing to sandwich the wires therebetween; wherein the insulation displacement portion defines a U-shaped configuration having opposite first and second walls each with lances at one end, and a bight connecting said first and second wall and extending in a direction same as that of the tunnel; wherein the contact further includes a mating portion extending from the other end of said first wall and away from the corresponding lances.

* * * * *